United States Patent [19]

Jordan

[11] Patent Number: 4,862,542

[45] Date of Patent: Sep. 5, 1989

[54] WATERBED BURPER

[76] Inventor: Tommy D. Jordan, 3078 S. Oakland Forest Dr., Apt. 605, Fort Lauderdale, Fla. 33309

[21] Appl. No.: 314,890

[22] Filed: Feb. 24, 1989

[51] Int. Cl.[4] ..... A47C 21/00; A47C 31/00

[52] U.S. Cl. ..... 5/508; 5/451; 29/110.5

[58] Field of Search ..... 5/451, 508; 100/156, 100/210; 29/110.5 X, 119, 123

[56] References Cited

U.S. PATENT DOCUMENTS

| | | | |
|---|---|---|---|
| 2,725,830 | 12/1955 | Shebesta | 29/110.5 |
| 3,831,238 | 8/1974 | Adams | 29/110.5 |
| 4,314,395 | 2/1982 | Brock | 29/110.5 |
| 4,639,961 | 2/1987 | Chasan | 5/508 |

FOREIGN PATENT DOCUMENTS

| | | | |
|---|---|---|---|
| 2105967 | 4/1983 | United Kingdom | 29/110.5 |

*Primary Examiner*—Gary L. Smith
*Assistant Examiner*—Michael J. Milano
*Attorney, Agent, or Firm*—Oltman and Flynn

[57] ABSTRACT

A waterbed burper having an elongated roller and handles rotatably holding the roller. Rubber end caps on the roller cause it to rotate in the handles while it is being displaced along the top of the waterbed toward the end near where the usual air/water valve is located. Near this end, the handles can be turned on the roller down into engagement with the waterbed and then slid along the roller across the top of the waterbed toward the valve. Each handle is extensible selectively to fit waterbeds of different widths.

20 Claims, 2 Drawing Sheets

WATERBED BURPER

SUMMARY OF THE INVENTION

This invention relates to a device for forcing air from a waterbed through the usual air/water valve located near one end of the waterbed.

When a waterbed is filled with water, it is not uncommon for air to be trapped in the waterbed. This often detracts from the user's enjoyment of the waterbed.

The present invention is directed to a novel waterbed burper for forcing air out of the waterbed through the usual air/water valve near one end.

In accordance with this invention, the waterbed burper has a pair of handles rotatably holding an elongated roller and slidably adjustable along the roller. In use, two persons on opposite sides of the waterbed grasp the handles and roll the roller lengthwise over the top of the waterbed to force air toward the air/water valve near one end. Rubber end caps on the roller insure that it rotates in the handles while being displaced along the top of the waterbed. The roller is stopped just short of this valve and then the handles are turned on the roller so that they engage the top of the waterbed between the roller and the adjacent end of the waterbed, after which the handles are slid along the roller across the top of the waterbed toward the valve, forcing air ahead of them and causing the air to be vented through the valve. Preferably, each handle is selectively extensible from the roller so that it can engage whatever length of the waterbed remains between the roller and the adjacent end of the waterbed. Preferably, also, each handle has an arcuate segment which extends more than half-way around the circumference of the roller to rotatably hold the roller and enable the handle to be turned on the roller and slid along the roller.

A principal object of this invention is to provide a novel waterbed burper which can be conveniently used to remove air from a waterbed.

Another object of this invention is to provide such a waterbed burper which can be used on waterbeds having the usual air/water valve at various different locations near one end.

Another object of this invention is to provide such a waterbed burper which can be converted readily for use on waterbeds of different widths.

Another object of this invention is to provide a novel waterbed burper with an elongated roller rotatably mounted in handles which can be pushed down while the roller is displaced along the top of a waterbed and having frictional members encircling the roller and frictionally engageable with the top of the waterbed to make sure that the roller turns in the handles as it is displaced along the waterbed.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
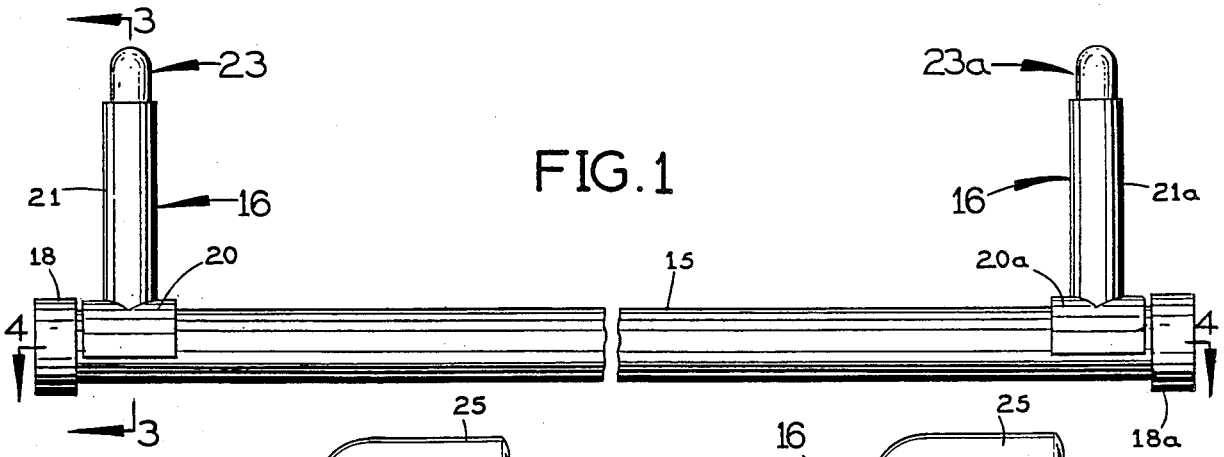
FIG. 1 is a front elevational view of the present waterbed burper with part of its roller broken away.
Figure 2:
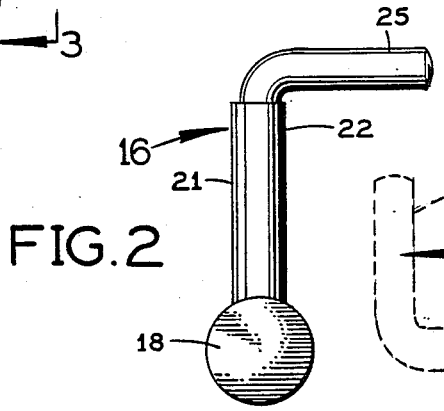
FIG. 2 is an end elevation taken from the right end of FIG. 1.

Referring to FIG. 1, the waterbed burper of the present invention comprises an elongated, hollow, cylindrical roller 15 and a pair of identical handles 16 and 16a. Each handle rotatably receives the roller and is slidable along the roller.

Figure 4:
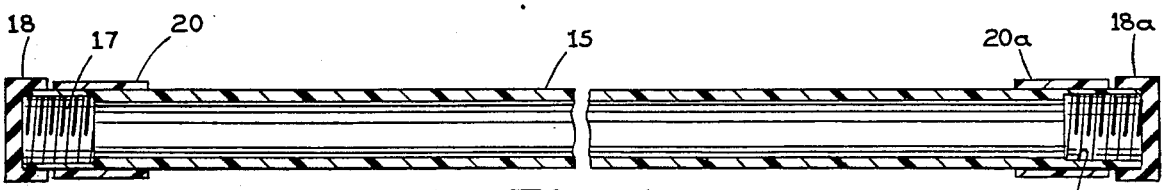
FIG. 4 is a longitudinal horizontal section through the roller, taken along the line 4—4 in FIG. 1.

As shown in FIG. 4, the roller 15 has a screwthreaded socket 17 in its left end and a similar socket 17a in its right end. A manually attachable and removable end cap 18 fits over the left end of the roller, closing the outer end of socket 17. End cap 18 has a cylindrical periphery. An identical end cap 18a normally fits over the opposite end of the roller. Preferably, each cap is of rubber which has a high enough coefficient of friction with the top of the waterbed to insure that the roller 15 actually rotates in the handles 16 and **16*a*** and rolls over the waterbed and does not merely slide across it.

Figure 3:
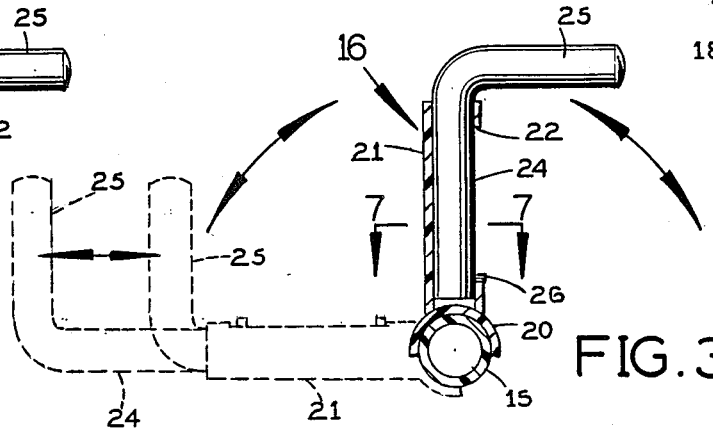
FIG. 3 is a vertical section taken along the line 3—3 in FIG. 1 through one of the handles on the waterbed burper, showing one operating position of the handle in full lines and two different alternative operating positions in phantom.

Referring to FIG. 1 and 3, the handle 16 has an approximately semi-cylindrical arcuate segment 20 that rotatably receives the roller 15 inward from end cap 18. Arcuate segment 20 extends slightly more than half-way around the circumference of the roller, as shown in FIG. 3, and it is both rotatable and slidable lengthwise on the roller. The outside diameter of arcuate segment 20 of handle 16 is slightly less than the outside diameter of each end cap 18 and 18a.

Figure 7:
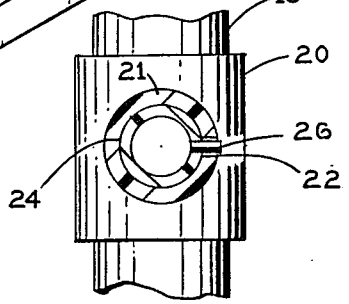
FIG. 7 is a cross-section through one of the handles, taken along the line 7—7 in FIG. 3.

The handle also has a transverse segment in the form of a cylindrical sleeve 21 rigidly joined to its arcuate segment 20 midway circumferentially of segment 20. Sleeve 21 extends perpendicular to roller 15 and it has a narrow longitudinal slot 22 in one side. The handle also has a right-angled member 23 with a straight, cylindrical, first leg 24 that is snugly but slidably received in sleeve 21 and a straight second leg 25 joined to the outer end of leg 24 beyond sleeve 21 and extending perpendicular to it to be grasped by a person's hand. Leg 24 carries an outwardly projecting pin 26 (FIG. 7) which is slidably recieved in slot 22 in sleeve 21 of the handle.

The outer handle 16a has the same construction and mode of use as handle 16, with like elements being given the same reference numerals and an "a" suffix as the elements of handle 16.

With this arrangement, each handle 16 or 16a can be turned pivotally on roller 15, for example, between the full line position of FIG. 3, in which the sleeve segment 21 of handle 16 extends up from the roller, and the phantom line position of FIG. 3, in which the transverse sleeve segment 21 of this handle extends substantially horizontally from the roller at substantially the same level as the roller. Also, the right-angled member 23 of this handle can be slid along its sleeve segment 21 when the sleeve segment is down on the waterbed, as shown by the two phantom line figures in FIG. 3, between the retracted position in which its pin 26 engages the inner end of slot 22 in sleeve 21 (i.e., the end of that slot closest to roller 15), and an extended position in which its pin 26 engages the outer end of slot 22 (i.e., the end of that slot remote from roller 15).

Figure 8:
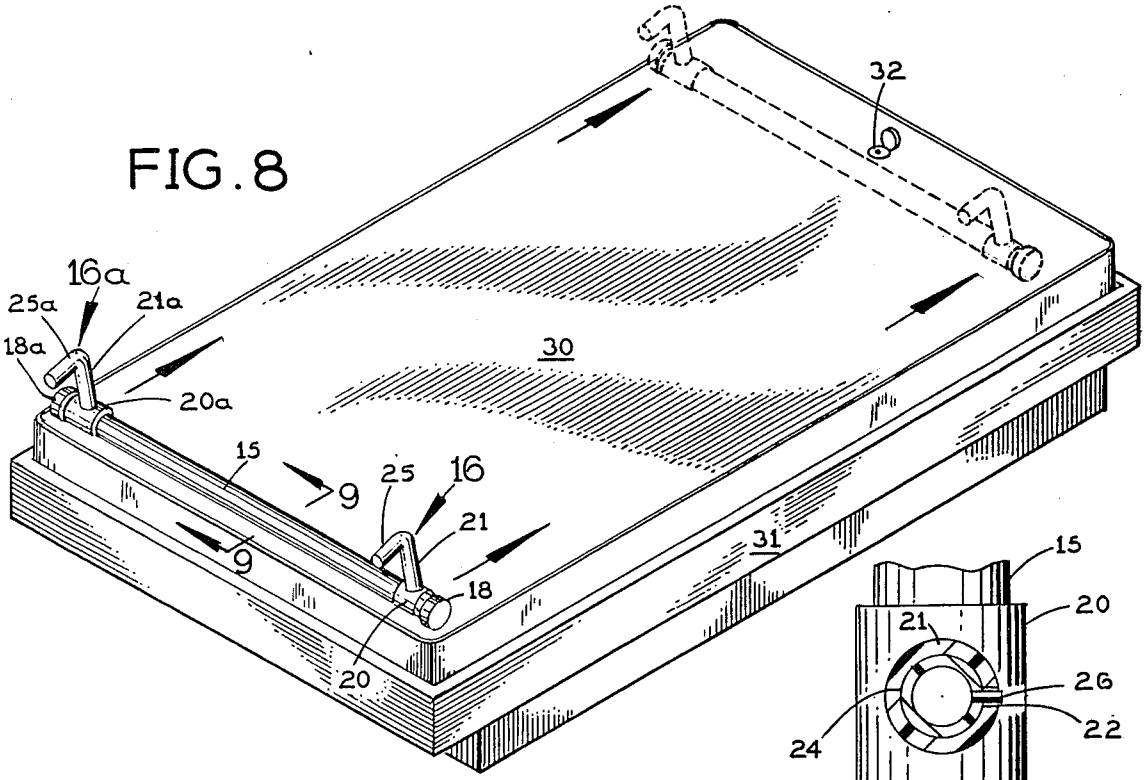
FIG. 8 is a perspective view showing how the roller in the present burper can be rolled along a waterbed from the full line position to the phantom line position to force any trapped air toward the end of the waterbed where the usual air/water valve is located.
Figure 9:
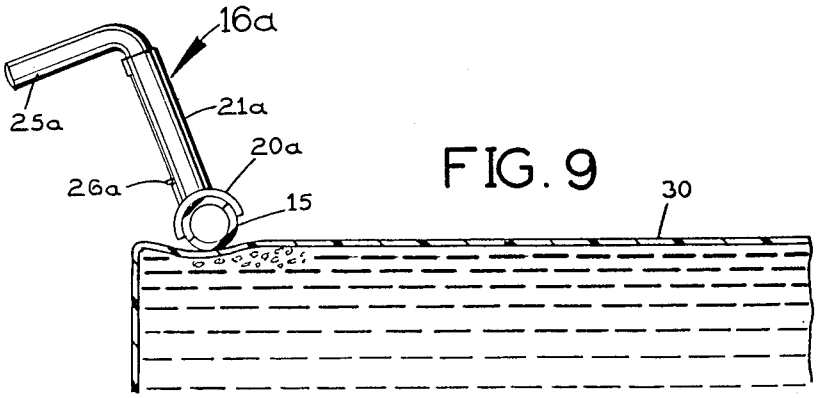
FIG. 9 is a fragmentary longitudinal vertical section taken along the line 9—9 in FIG. 9 at the end of the waterbed where the burping operation starts.

FIG. 8 shows a conventional waterbed 30 supported by a waterbed frame 31 and having an air/water valve 32 near one end. The present waterbed burper is positioned on the waterbed with its roller 15 extending from side-to-side across the waterbed and its handles 16 and 16a extending up from roller 15 just inward from the respective end caps 18 and 18a. Two persons standing on opposite sides of the waterbed grasp the respective handles 16 and 16a and they push down on the handles while rolling the roller 15 over the top of the waterbed lengthwise of the waterbed, as indicated by the arrows in this Figure. The end caps 18 and 18a on roller 15 have a sufficient coefficient of friction with the top of the waterbed to cause the roller to rotate in the arcuate segments 20 and 20a of handles 16 and 16a and not merely slide non-rotatively over the waterbed as it is displaced along the waterbed. This action causes any air in the waterbed to be pushed ahead of roller 15 toward the end of the waterbed near the air/water valve 32.

Figure 11:
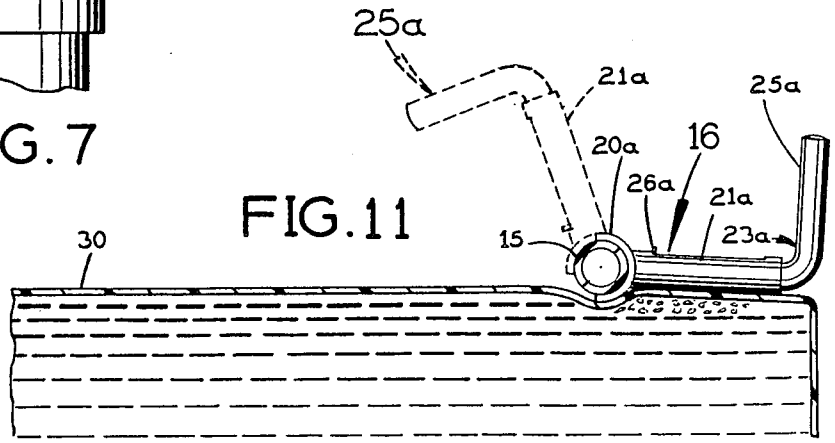
FIG. 11 is a fragmentary longitudinal vertical section taken along the line 11—11 in FIG. 10.

The roller 15 is stopped when it reaches a position just short of the air/water valve 32, as shown in phantom in FIG. 8. Then each person turns the handle 16 or 16a that he or she is holding clockwise in FIG. 11 from the phantom line position to the full line position, in which the sleeve 21 or 21a of the handle is substantially horizontal and at substantially the same level as roller 15 so as to engage the top of the waterbed, and the leg 25 or 25a of the right-angled member 23 or 23a in the handle extends up from sleeve 21 or 21a. Now each person slides the respective handle laterally inward across the waterbed 30 along the roller 15 and toward the air/water valve 32. These actions push any trapped air at this end of the waterbed laterally inward toward the valve 32, where it is vented to the atmosphere. Each handle 16 and 16a can be slid along the roller 15 without obstruction to whatever postion the valve 32 may be at from side-to-side on the waterbed.

Depending upon the position of the valve 32 with respect to the adjacent end of the waterbed, the users may extend the respective handles by pulling the right-angled members 23 and 23a out along the corresponding sleeve segments 21 or 21a so that the combined length of the sleeve 21 or 21a and the exposed part of leg 24 or 24a of the right-angled member 23 or 23a extends from the roller 15 completely to that end of the waterbed.

From the foregoing, it will be evident that the illustrated embodiment constitutes an effective and conveniently usable device for removing air from a waterbed, especially after it has just been filled with water, which usually results in some air accumulating in the waterbed. The handles 16 and 16a are readily manipulated, first to roll the roller 15 lengthwise of the waterbed and then, after the roller reaches a position close to the end of the waterbed near where its air/water valve 32 is located and after being pivoted on the roller down into engagement with the waterbed themselves, to slide along the roller and push air laterally inward toward the air/water valve 32.

Figure 5:
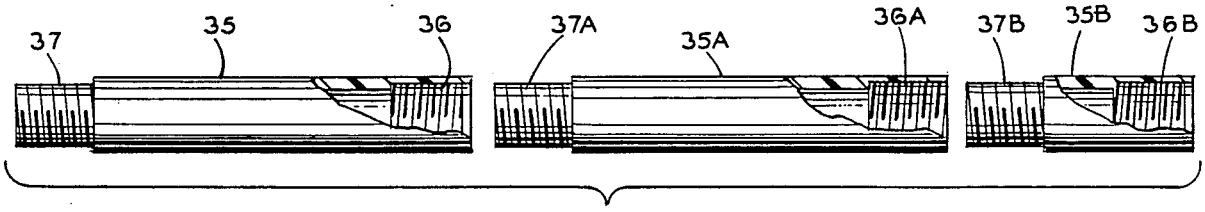
FIG. 5 is an exploded elevational view of extensions for the roller, with parts broken open.

In one practical embodiment, the length of roller 15 is about 44 inches. This may be substantially less than the side-to-side width of a particular waterbed, in which event one or more extensions as shown in FIG. 5 may be attached to the roller. One of these extensions is designated by the reference numeral 35 in FIG. 5, the others by reference numerals 35A and 35B, respectively.

Figure 6:
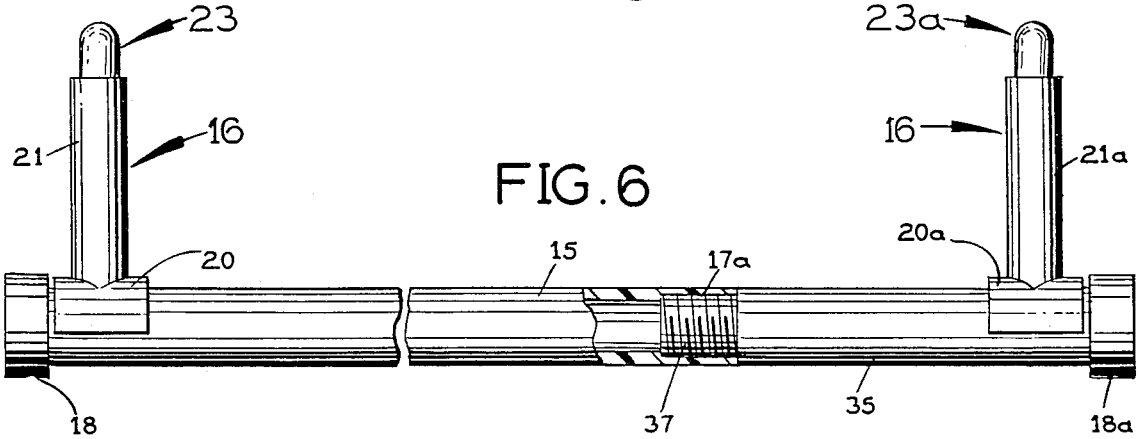
FIG. 6 is a view like FIG. 1 with one of the FIG. 5 extensions attached to the roller to increase its length.
Figure 10:
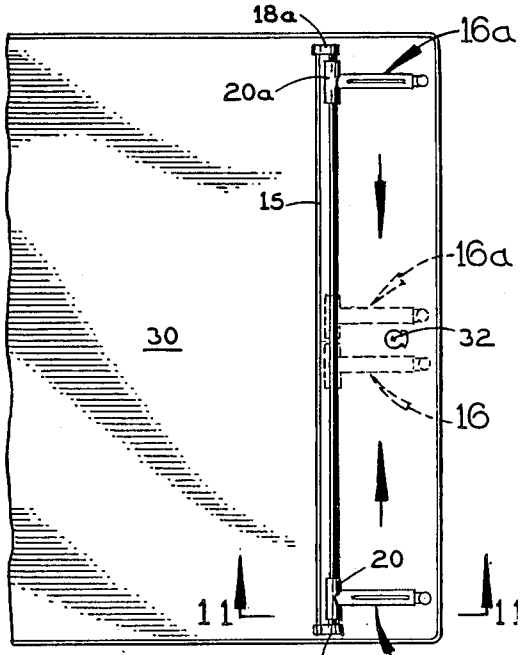
FIG. 10 is a fragmentary top plan view showing the present burper at the valve end of the waterbed, with the handles shown in full lines outward along the roller and in phantom lines inward along the roller at the completion of the burping operation.

Extension 35 is a generally cylindrical body of the same outside diameter as roller 15 and with a screw-threaded socket 36 in one end and a screw-threaded stem 37 on the opposite end which is threadedly insertable into and removable from either socket 17 or 17a in roller 15. Thus, as shown for example in FIG. 6, after removing the end cap 18a from roller 15, the stem 37 of extension 35 may be screwed into socket 17a in roller 15 and the end cap 18a may be put on the outer end of extension 35. The extension 35 is a smooth continuation of roller 15 and the arcuate segment 20a of handle 16a can slide freely along both of them.

Extension 35A is identical to extension 35 and may be used in place of or in addition to extension 35, depending upon the width of the waterbed on which the present burper is to be used.

Extension 35B is shorter than extension 35 or 35A but except for this is identical to them.

Elements of extensions 35A and 35B which correspond to the elements of extension 35 have the same reference numerals, with an "A" or "B" suffix added.

I claim:

1. A waterbed burper comprising:

an elongated roller adapted to extend across the top of a waterbed;

and a pair of handles on said roller, each of said handles having means thereon rotatably holding said roller and slidably adjustable along said roller, each of said handles also having a transverse segment which extends away from said roller, each of said handles being pivotally adjustable on said roller between a position in which said transverse segment extends up from said roller and a position in which said transverse segment extends at substantially the same level as said roller to engage the waterbed on one side of the roller.

2. A waterbed burper according to claim 1 wherein each of said handles has a leg extending transversely from said transverse segment to be grasped by a person for rolling the roller along the top of the waterbed, for pivoting the handle on the roller, and for sliding the handle along the roller across the top of the waterbed.

3. A waterbed burper according to claim 2 wherein said means on each handle rotatably holding said roller is an arcuate segment which snugly but slidably engages the roller more than half-way around its circumference.

4. A waterbed burper according to claim 3 and further comprising frictional members encircling said roller and frictionally engageable with the top of the waterbed to cause said roller to rotate in said handles as the roller is moved along the top of the waterbed while downward force is exerted on said handles.

5. A waterbed burper according to claim 4 wherein said frictional members are end caps of rubber-like material on the opposite ends of said roller.

6. A waterbed burper according to claim 1 and further comprising frictional members encircling said roller and frictionally engageable with the top of the waterbed to cause said roller to turn in said handles when displaced along the top of the waterbed.

7. A waterbed burper according to claim 1 wherein said means on each handle rotatably holding said roller is an arcuate segment which snugly but slidably engages the roller more than half-way around its circumference.

8. A waterbed according to claim 7 and further comprising frictional members encircling said roller adjacent said handles and frictionally engaging the top of the waterbed to cause said roller to turn in said handles while being displaced along the top of the waterbed.

9. A waterbed burper according to claim 1 wherein each of said handles is extensible longitudinally of said transverse segment.

10. A waterbed burper according to claim 9 wherein each of said handles has a member with a first leg slidably adjustable along said transverse segment of the handle and a second leg extending transverse to said first leg beyond said transverse segment to be grasped thereat by a person's hand.

11. A waterbed burper according to claim 10 wherein said means on each handle rotatably holding said roller is an arcuate handle segment which snugly but slidably engages the roller more than half-way around its circumference.

12. A waterbed burper according to claim 11 and further comprising a pair of frictional members encircling said roller adjacent said handles and frictionally engageable with the top of the waterbed to cause said roller to rotate in said arcuate segments of the handles when displaced along the top of the waterbed while downward force is exerted on said handles.

13. A waterbed burper according to claim 12 wherein said frictional members are rubber end caps on the opposite ends of said roller.

14. A waterbed burper according to claim 13 wherein:

said roller has screw-threaded sockets in its opposite ends;

and said end caps are manually removable from said roller; and further comprising:

a plurality of roller extensions, each having a screw-threaded stem on one end threadedly receivable in one of said sockets in said roller and having a periphery beyond said stem which merges smoothly with the periphery of said roller to provide a continuation of the roller, each of said roller extensions having a screw-threaded socket in its opposite end adapted to threadedly receive said stem of another of said roller extensions.

15. A waterbed burper according to claim 1 wherein said roller has a screw-threaded socket in one end, and further comprising:

a roller extension with a screw-threaded stem threadedly receivable in said socket, said roller extension beyond said stem having a periphery that merges smoothly with the periphery of said roller to provide a continuation of the roller.

16. A waterbed burper comprising:

an elongated cylindrical roller adapted to extend across the top of a waterbed;

and a pair of handles on said roller, each of said handles having an arcuate segment which slidably engages said roller more than half-way around the circumference of the roller to enable said roller to turn in said arcuate segment and to enable said arcuate segment to turn on said roller and to slide along said roller, and each of said handles having a transverse segment connected to said arcuate segment and extending away from said roller.

17. A waterbed burper according to claim 16 wherein:

said transverse segment of each handle is a hollow sleeve;

and each of said handles also has a member with a first leg closely received in said sleeve and a second leg connected to said first leg beyond said sleeve and extending transverse to said sleeve.

18. A waterbed burper according to claim 17 wherein said first leg is slidably received in said sleeve to enable the length of said handle away from the roller to be extended.

19. A waterbed burper comprising:

an elongated cylindrical roller adapted to extend across the waterbed;

and a pair of handles on said roller, each of said handles having:

an arcuate segment which snugly but slidably engages said roller more than half-way around the circumference of the roller to enable said roller to rotate with respect to said arcuate segment and to enable said arcuate segment to pivot on said roller and to slide along said roller;

a hollow sleeve attached to said arcuate segment and extending away from said roller, said sleeve having a longitudinal slot therein;

and a member having a first leg slidably received in said sleeve, a second leg extending transverse to said first leg beyond said sleeve to be grasped thereat by a person's hand, and a projection on said first leg slidably received in said slot in said sleeve to enable said member to be slid out along said sleeve.

20. A waterbed burper according to claim 9 and further comprising:

a pair of rubber members encircling said roller adjacent said handles and frictionally engageable with the top of the waterbed to cause the roller to rotate in said arcuate segments of the handle as said roller is moved along the top of the waterbed while downward force is exerted on said handles.

* * * * *